US006609961B2

(12) United States Patent
Lacy et al.

(10) Patent No.: US 6,609,961 B2
(45) Date of Patent: Aug. 26, 2003

(54) CHEMICAL MECHANICAL PLANARIZATION BELT ASSEMBLY AND METHOD OF ASSEMBLY

(75) Inventors: Michael S. Lacy, Pleasanton, CA (US); John M. Boyd, Atascadero, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/757,452

(22) Filed: Jan. 9, 2001

(65) Prior Publication Data

US 2002/0090899 A1 Jul. 11, 2002

(51) Int. Cl.[7] ..... B24B 21/00

(52) U.S. Cl. ..... 451/296; 451/168; 451/533

(58) Field of Search ..... 451/296, 307, 451/526, 531, 532, 533, 168, 41; 156/137, 138, 139, 140

(56) References Cited

U.S. PATENT DOCUMENTS

| | | | |
|---|---|---|---|
| 4,018,574 | A | 4/1977 | Dyer |
| 4,576,612 | A | 3/1986 | Shukla et al. |
| 4,589,233 | A | 5/1986 | Parekh et al. |
| 4,728,552 | A | 3/1988 | Jensen, Jr. |
| 4,753,838 | A | 6/1988 | Kimura et al. |
| 4,841,680 | A | 6/1989 | Hoffstein et al. |
| 4,841,684 | A | 6/1989 | Hall, Jr. |
| 4,927,432 | A | 5/1990 | Budinger et al. |
| 4,954,141 | A | 9/1990 | Takiyama et al. |
| 4,962,562 | A | 10/1990 | Englund et al. |
| 5,020,283 | A | 6/1991 | Tuttle |
| 5,177,908 | A | 1/1993 | Tuttle |
| 5,197,999 | A | 3/1993 | Thomas |
| 5,212,910 | A | 5/1993 | Breivogel et al. |
| 5,234,867 | A | 8/1993 | Schultz et al. |
| 5,257,478 | A | 11/1993 | Hyde et al. |
| 5,287,663 | A | 2/1994 | Pierce et al. |
| 5,305,560 | A | 4/1994 | Roelofs |
| 5,329,734 | A | 7/1994 | Yu |
| 5,341,609 | A | 8/1994 | Gorsuch et al. |
| 5,383,309 | A | 1/1995 | Sampietro |
| 5,433,651 | A | 7/1995 | Lustig et al. |
| 5,441,598 | A | 8/1995 | Yu et al. |
| 5,487,697 | A | 1/1996 | Jensen |
| 5,489,233 | A | 2/1996 | Cook et al. |
| 5,534,106 | A | 7/1996 | Cote et al. |
| 5,558,568 | A | 9/1996 | Talieh et al. |

(List continued on next page.)

FOREIGN PATENT DOCUMENTS

| | | | |
|---|---|---|---|
| EP | 0 696 495 | A1 | 2/1996 |
| EP | 0 738 561 | A1 | 10/1996 |
| EP | 0 824 995 | A1 | 2/1998 |
| JP | 06047678 | | 2/1994 |
| WO | WO 93/1291 | | 7/1993 |
| WO | WO 98/35785 | | 8/1998 |
| WO | WO 01/15863 | A1 | 3/2001 |
| WO | WO 01/15867 | A1 | 3/2001 |

OTHER PUBLICATIONS

English Abstract of Japanese Publication No. 03055170, Entitled "Grinding Belt and Grinder Using It", Mar. 8, 1991, 1 page.

*Primary Examiner*—Dung Van Nguyen
(74) *Attorney, Agent, or Firm*—Brinks Hofer Gilson & Lione

(57) ABSTRACT

A method of producing a chemical mechanical planarization (CMP) polishing belt structure is disclosed that includes forming a strip of substantially rigid material into a support belt having an interior surface and an exterior surface. At least a portion of the exterior surface of the support belt is altered to form a plurality of gripping members integral with the exterior surface of the support belt. An interior surface of a seamless CMP belt is applied to the exterior surface of the support belt such that the plurality of gripping members engage the interior surface of the seamless CMP belt in a non-slip grip.

32 Claims, 5 Drawing Sheets

U.S. PATENT DOCUMENTS 5,573,619 A 11/1996 Benedict et al.
5,573,844 A 11/1996 Donovan et al.
5,575,707 A 11/1996 Talieh et al.
5,578,362 A 11/1996 Reinhardt et al.
5,593,344 A 1/1997 Weldon et al.
5,605,760 A 2/1997 Roberts
5,650,039 A 7/1997 Talieh
5,690,540 A 11/1997 Elliott et al.
5,692,947 A 12/1997 Talieh et al.
5,722,877 A 3/1998 Meyer et al.
5,762,536 A 6/1998 Pant et al.
5,800,248 A 9/1998 Pant et al.
5,871,390 A 2/1999 Pant et al.
5,916,012 A 6/1999 Pant et al.
6,068,539 A 5/2000 Bajaj et al.

CHEMICAL MECHANICAL PLANARIZATION BELT ASSEMBLY AND METHOD OF ASSEMBLY

FIELD OF THE INVENTION

The present invention relates generally to equipment for processing semiconductor wafers. More particularly, the present invention relates to a polishing belt and associated linear polisher for chemical mechanical polishing of semiconductor wafers.

BACKGROUND

Chemical mechanical polishing (CMP) is used for planarizing semiconductor wafers during processing of the wafers. Because semiconductor circuits on wafers are commonly constructed in layers, where a portion of a circuit is created on a first layer and conductive vias connect it to a portion of the circuit on the next layer, each layer can add or create topography on the wafer that must be smoothed out before generating the next layer. In order to improve the manufacturability of the circuits on the wafer, many processing steps require planarizing the wafer surface. For example, to improve the uniformity of deposition of the conductive vias, the wafer is planarized prior to deposition to reduce the peaks and valleys on the surface over which the metal is deposited.

In conventional planarization technology, a semiconductor wafer is supported face down against a moving polishing pad. Two types of polishing or planarizing apparatus are commonly used. In rotary planarizing technology, a wafer is secured on a chuck and is brought into contact with the polishing surface. A flat polishing pad mounted on a rotating table forms the polishing surface. In linear planarizing technology, an endless belt travels over two or more rollers. The wafer is placed against the moving polishing surface of the belt. An example of a linear polishing system is the Teres™ CMP System manufactured by Lam Research Corporation, Fremont, Calif.

A key component of a linear CMP system is the polishing belt assembly. Conventionally, the belt assembly includes a supporting band made of stiff material such as stainless steel. Polishing pads are attached to the stainless steel to form the polishing surface. In some cases, the pads have two layers, for example, a soft cushion layer and a polishing layer. The stainless steel band forms a strong, reliable support for the polishing pads.

The polishing pad needs to be attached with the supporting band so that it does not slip out of place, or deform due to excessive stretching and wear and become loosely attached with the support band. With conventional CMP systems, the polishing pad is attached to the supporting band with an adhesive such as a pressure sensitive adhesive. However, the pads typically have a finite lifetime, for example, 500 wafers. When the pads become worn, they must be removed and replaced. Using an adhesive may necessitate a longer change out time for a replacement polishing pad, because the "old"adhesive will have to be removed from the supporting band before a new polishing pad can be attached to the supporting band.

Furthermore, adhesives may wear and lose their adhering qualities, causing the polishing pad to slip out of position. Alternatively, the polishing pad may stretch an excessive amount and deform, resulting in a polishing pad that is loosely attached to the support band. Either alternative may lead to wafers being improperly polished.

Accordingly, there is a need in the art for an improved polishing belt assembly for CMP systems.

BRIEF SUMMARY

A method for producing a chemical mechanical planarization polishing belt structure is provided herein. According to a first aspect of the method, a strip of substantially rigid material is formed into a support belt having an interior surface and an exterior surface. At least a portion of the exterior surface of the support belt is altered to form a plurality of gripping members integral with the exterior surface of the support belt. Finally, an interior surface of a seamless CMP belt is applied to the exterior surface of the support belt, with the plurality of gripping members engaging the interior surface of the seamless CMP belt in a non-slip grip.

According to another aspect of the method, a plurality of gripping members is attached to at least a portion of the exterior surface of the support belt.

A chemical mechanical planarization polishing belt structure is also provided herein. A first aspect of the belt structure includes an inner support belt constructed of a rigid material having an outer surface. The outer surface of the inner support belt comprises a plurality of mechanical grips integrally formed from displaced support belt material. An outer belt having an inner surface mechanically engages with the mechanical grips of the inner support belt. The outer belt also includes an outer surface that comprises a seamless CMP polishing pad. The outer diameter of the inner support belt is larger than the inner diameter of the outer belt.

In another embodiment, the outer surface of the inner support belt includes a plurality of mechanical grips attached to the outer surface of the inner support belt.

DETAILED DESCRIPTION OF THE PRESENTLY PREFERRED EMBODIMENTS

Figure 1:
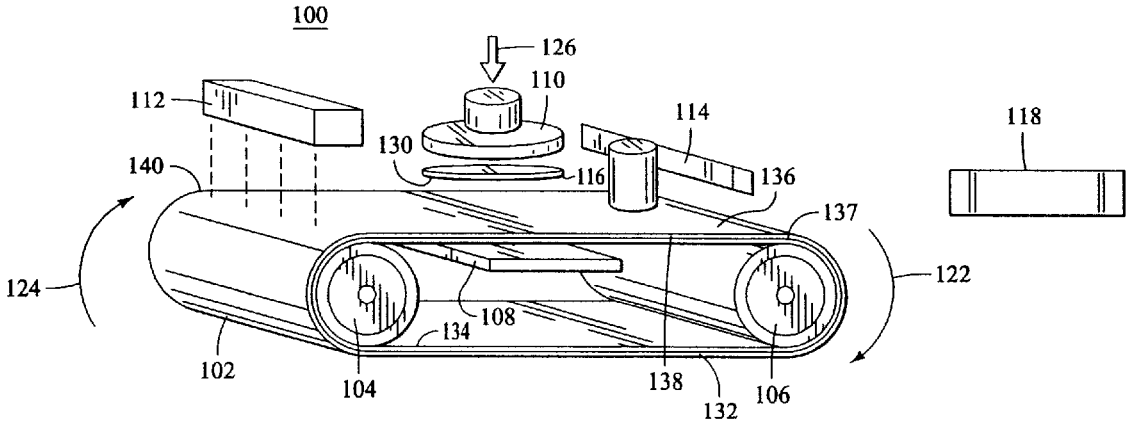
FIG. 1 is a perspective view of an embodiment of a linear chemical mechanical polishing system.

Referring now to the drawings, FIG. 1 is a perspective view of a linear chemical mechanical polishing or planarization (CMP) system 100 for polishing a workpiece. The system 100 includes a belt assembly 102, a first roller 104, a second roller 106, a platen 108, a polishing head 110, a slurry dispenser 112, a conditioner 114, and a controller 118. The system 100 in the illustrated embodiment is adapted for planarization of semiconductor wafers such as the semiconductor wafer 116. However, the operative principles embodied in the system 100 may be applied to chemical mechanical polishing of other workpieces as well.

The rollers 104,106 are located a predetermined distance apart to retain the belt assembly 102 and move the belt assembly 102 to permit linear planarization of the wafer 116. The rollers 104, 106 are turned, for example, by an electric motor in the direction indicated by the arrows 122, 124 in FIG. 1. The rollers 104, 106 thus form a transport means for moving the belt assembly in a continuous loop past the workpiece, wafer 116. Other transport means include combinations of wheels, pulleys and tensioning devices that maintain proper tension on the belt assembly 102, along with their associated drive elements such as electric motors and mechanical linkages. Operational parameters such as the speed and tension of the belt assembly 102 are controlled through the rollers 104, 106 by a controller 118. The controller 118 may include a processor or other computing device that operates in response to data and instructions stored in an associated memory.

The wafer 116 is mounted on the polishing head 110. The wafer 116 may be mounted and retained in place by vacuum force or by any other suitable mechanical technique. The polishing head 110 is mounted on an arm and is movable under control of the controller 118. The polishing head 110 applies a polishing pressure to the wafer 116 against the belt assembly 102. The polishing pressure is indicated in FIG. 1 by the arrow 126.

To further control the polishing pressure, the platen 108 is located opposite the polishing head 110 below the wafer 116. The belt assembly 102 passes between the front surface 130 of the wafer and the platen 108. The platen 108 applies pressure to the belt assembly 102, for example by direct contact with the belt assembly or by supplying pressurized air or water to the underside of the belt assembly. In some applications, the platen 108 is arranged to apply pressure in controllable zones or areas of the platen 108 under control of the controller 118. For example, the zones may be arranged radially on the surface of the platen 108. This controlled application of pressure through the platen 108 allows the belt assembly 102 to polish uniformly across the surface 130 of the wafer 116.

The slurry dispenser 112 dispenses a slurry onto the belt assembly 102. Generally, the slurry includes two components. Different applications will require different components of the slurry, depending on the material to be removed or polished. In one example, abrasive particles such as silicon dioxide or alumina are combined with a chemical such as potassium hydroxide. The chemical operates to soften or hydrate the surface and the abrasive particles operate to remove the surface material. The exact components of the slurry are chosen based on the material to be polished or planarized. For example, the slurry components for planarizing a silicon dioxide layer on the surface 130 of the wafer 116 will differ from the slurry components for planarizing a metal layer on the surface 130. Similarly, the slurry components appropriate for a tungsten metal layer will be different from the components for a copper layer, which is softer than tungsten. For uniform planarization or polishing, the slurry preferably will be distributed evenly across the surface 130 of the wafer 116.

The conditioner 114 treats the surface of the belt assembly 102 to keep the belt's roughness or abrasiveness relatively constant. As the belt assembly 102 planarizes or polishes the wafer 116, there is some deposit of the material removed from the wafer 116 on the surface of the belt assembly 102. If too much material from the surface of wafer 116 is deposited on the belt assembly 102, the removal rate of the belt 102 will drop quickly and the uniformity of abrasion across the wafer will be degraded. The conditioner 114 cleans and roughens the surface of the belt assembly 102.

The belt assembly 102 is preferably an endless loop polishing assembly and includes a polishing pad 132 and a belt support 134. The polishing pad 132 is made with a single endless layer that provides a surface for polishing a workpiece such as the wafer 116 in the chemical mechanical polishing system 100. Preferably, the polishing pad 132 is a polymeric layer forming an endless loop having a predetermined width and a predetermined length to fit the chemical mechanical polishing system 100. The polishing pad 132 includes a top or polishing surface 136 on one side of the endless loop, an opposing bottom surface 137, a first edge 138, and a second edge 140.

The single endless layer forming the polishing pad 132 can be any suitable polishing material with sufficient strength, flexibility, and durability. In one preferred embodiment, the polishing pad 132 is manufactured of a single, substantially uniform layer of polymeric material such as polyurethane. However, in other embodiments, the polishing material may be made of any suitable polymeric material having a substantially uniform thickness and structure including rubbers or plastics. Examples of rubbers and plastics include, but are not limited to, microcellular urethane, polyureas, polyesters, polyethers, epoxies, polyamides, polycarbonates, polyetheylenes, polypropylenes, fluoropolymers, vinyl polymers, acrylic and methacrylic polymers, silicones, latexes, nitrile rubbers, isoprene rubbers, butadiene rubbers, and various copolymers of styrene, butadiene, and acrylonitrile. The polymeric material may be thermoset or thermoplastic.

The polishing pad 132 may be solid or cellular. A solid layer is preferably uniformly solid throughout its length and cross section. Cellular polymers include voids or porosity that helps the polishing process by carrying the slurry to the surface 130 of the wafer. The cells may be open or closed and can be formed by any suitable means, including but not limited to blowing, expansion, frothing, and inclusion of hollow microelements. The polishing layer may include various additives, including but not limited to lubricants and abrasive particles. The belt should be sufficiently elastic to maintain tension during use. The belt may be expected to operate at temperatures ranging from approximately +10° C. to +90° C.

Figure 2:
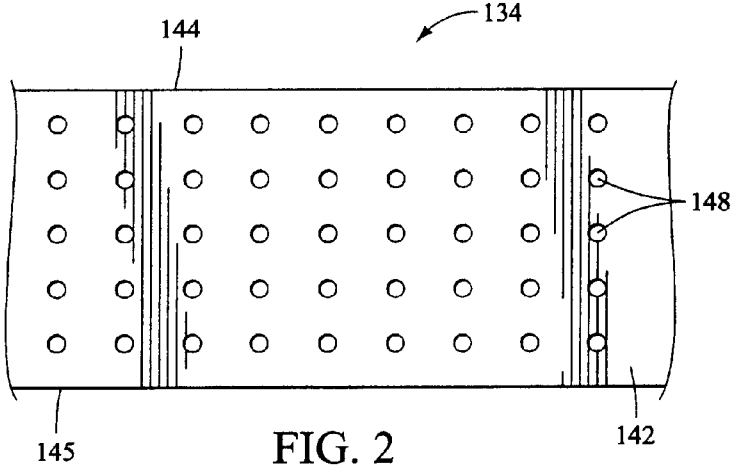
FIG. 2 is a top plan view of a belt support having a plurality of gripping members formed using a punch.
Figure 3:
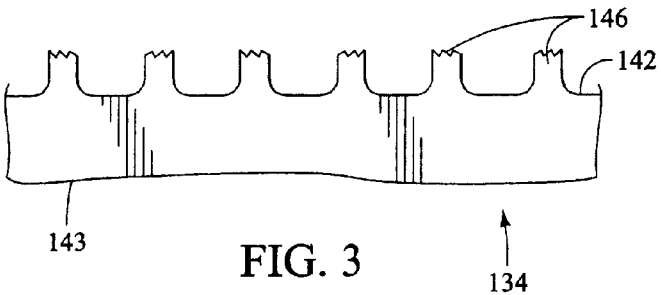
FIG. 3 is a side plan view of the belt support of FIG. 2.

Referring to FIGS. 1 and 2, the belt support 134 is an endless loop belt that provides the mechanical strength for mounting, tensioning and tracking the belt on the rollers 104,106. The belt support 134 includes an outer side 142, an opposing inner side 143, a first edge 144, and an opposing second edge 145 (FIGS. 2 and 3). In a preferred embodiment, the belt support 134 is made from stainless steel and is formed using various manufacturing processes such as welding. In other embodiments, however, the belt support 134 may be made from other metals or may be made from plastics using an injection molding process.

The belt support 134 includes a plurality of gripping members 146 that protrude outwardly from and substantially perpendicular to the outer side 142. Preferably, the gripping members 146 are integral to the belt support 134, i.e., the belt support 134 is configured so that its outer side 142 includes gripping members 146. For example, the gripping members 146 may be formed using a punch to cold punch a plurality of holes 148 that protrude outwardly from the outer side 142 of the belt support 134. FIGS. 2 and 3 illustrate a belt support 134 having a plurality of gripping members 146 formed using a punch. The punch contacts the inner side 143, punches through the inner side 143 and the outer side 144, forming the gripping members 146 having holes 148 that protrude outwardly from the outer side 142.

Preferably, the gripping members 146 are separated from each other so as to form a uniform dimensional matrix, forming a grid-like pattern whose size is dependent on a CMP operation to be performed. Alternatively, however, a random pattern of gripping members 146 may be formed on the outer side 142.

Figure 4:
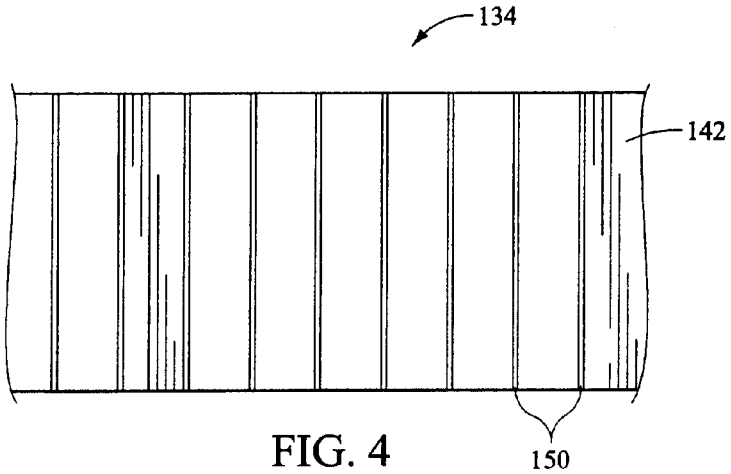
FIG. 4 is a top plan view of a belt support having a plurality of gripping members formed using a cold-chisel process.
Figure 5:
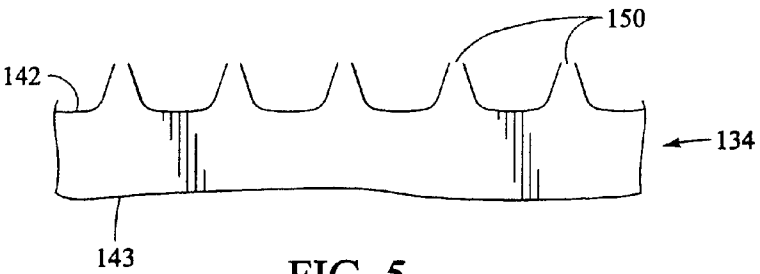
FIG. 5 is a side plan view of the belt support of FIG. 4.

In an alternative embodiment, a chisel may be used to form the gripping members 146 via a cold chiseling process. The outer side 142 is scratched with the chisel so that ridges 150 are formed that protrude outwardly from each side of the channels chiseled into the outer side 142 (FIGS. 4 and 5). Preferably, the ridges 150 extend across the width of the belt support 134, although the ridges 150 may be otherwise configured to extend over less than the entire width, depending on manufacturing requirements. In an alternate embodiment, the cold chisel process may be applied to the inner side 143 such that the chisel breaks completely through to the outer side 142 of the belt support 134 and forms ridges 150 on the outer side 142 of the belt support 134.

Similar to gripping members 146 formed with a punch, the ridges 150 preferably are separated from each other so as to form a uniform dimensional matrix, whose size is dictated by a given CMP operation. However, as with the grid pattern described above, this distance may be varied, and the ridges 150 may also be randomly dispersed over the outer side 142.

Figure 7:
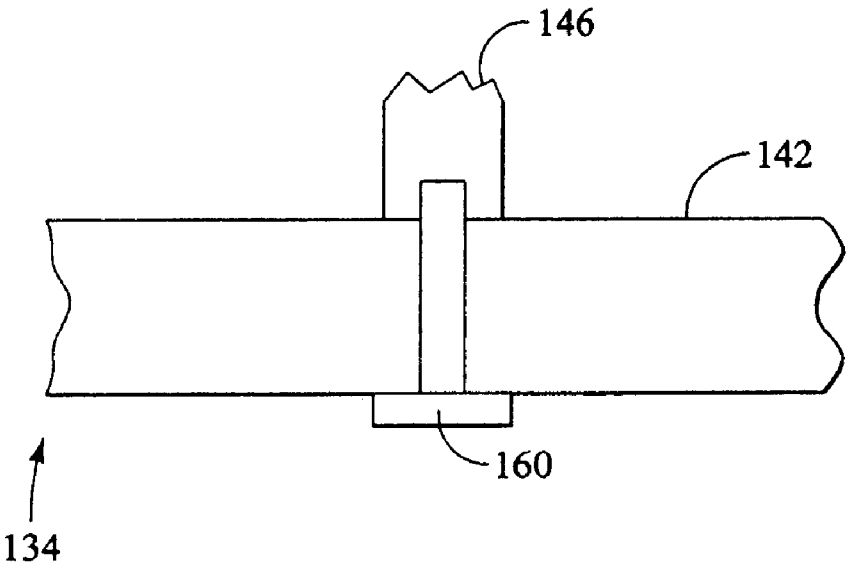
FIG. 7 is a cross sectional view of a gripping member attached to the belt support with a fastener.

Although it is preferred that the gripping members be integral to the belt support, in yet an alternative embodiment the gripping members may be separate members that are adhered to the belt support. The gripping members may be adhered to the belt support through the use of fasteners, adhesives, or the like. FIG. 7 shows a cross-sectional view of a gripping member 146 attached to the outer side 142 of the belt support 134 with a fastener 160.

In an alternate embodiment, the gripping members 146 may be formed at an angle not perpendicular to the outer side 142. For gripping members 146 that are not integral to the belt support 134, the gripping members 146 may be pre-formed so that they are offset at an angle relative to the outer side 142 when they are attached to the outer side 142.

As will be discussed further below, the bottom surface 137 of the polishing pad 132 is attached to the gripping members 146 of the belt support 134. Hence, the gripping members 146 should be formed so that they penetrate the bottom surface 137 of the polishing pad 132, but so that they do not penetrate the top surface 136 of the polishing pad 132. In a preferred embodiment, the gripping members 146 are approximately several thousandths of an inch in height. However, depending on manufacturing requirements, the gripping members 146 may be formed to other heights as well.

Figure 6:
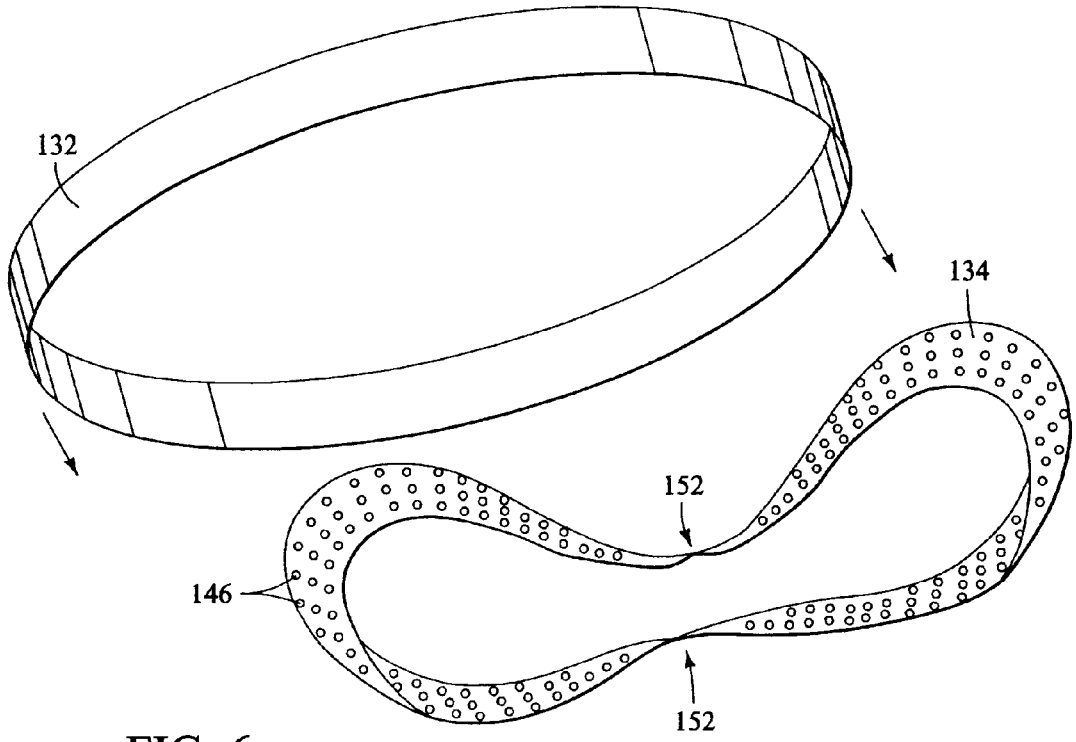
FIG. 6 is a perspective view of the belt support and the polishing pad.

Assembly of the belt support 134 and the polishing pad 132 is now described. A belt support 134 and polishing pad 132 as described above are provided. The belt support 134 and polishing pad 132 should be selected such that the outer diameter of the belt support 134 is larger than the inner diameter of the polishing pad 132 as manufactured. In a first embodiment, as illustrated in FIG. 6, the belt support 134 is deformed as indicated by arrows 152 so that the polishing pad 132 may be slipped over the belt support 134. In an alternate embodiment, the belt support 134 is mounted to the rollers 104, 106 of the CMP system 100 so that the gripping members 146 extend outwardly relative to the rollers 104, 106. For belt supports 134 that include directional gripping members 146, the belt support 102 preferably will be mounted to the rollers 104, 106 so that the gripping members 146 face the direction of travel of the belt support 134.

The polishing pad is then fit over the belt support 134 so that the first edges 138, 144 and the second edges 140, 145 of the polishing pad 132 and the belt support 134, respectively, are adjacent. The belt support 134 is then tensioned via the rollers 104, 106 so that the gripping members 146 of the outer side 142 of the belt support 134 penetrate the bottom surface 137 of the polishing pad 132.

Because the outer diameter of the belt support 134 is greater than the inner diameter of the polishing pad 132, the polishing pad will be tautly attached with the belt support 134, which will prevent the polishing pad 132 from becoming loosely attached with the belt support 134. The gripping members 146 will retain polishing pad 132 in position and will prevent the polishing pad 132 from slipping out of place. For belt supports 134 that use directional gripping members 146 as described above, the gripping members 146 will provide an even greater capability for holding the polishing pad 132 in place against forces incurred during the polishing process.

The advantages of this improved belt assembly are numerous. For example, in addition to the above-mentioned advantages, having a belt support whose outer diameter is larger than the inner diameter of the polishing pad provides a taut, rigid support to the polishing pad so that the gripping members of the belt support grip the polishing pad and so the polishing pad will not deform or loosen during tensioning of the rollers of the CMP system. Additionally, the gripping members prevent the polishing pad from slipping out of place during the wafer polishing process, preventing wafers from being improperly planarized.

Furthermore, a belt support having gripping members will reduce the maintenance time associated with replacing the polishing pad. Other belt assemblies typically have polishing pads that are adhesively bound to a belt support. Because polishing pads are consumables that need to periodically be changed, replacing polishing pads that are adhesively bound to a belt support may be difficult and time consuming. By contrast, a polishing pad that is attached to a belt support having gripping members may easily be replaced in a small amount of time.

Of course, it should be understood that a wide range of changes and modifications may be made to the embodiments described above. For example, instead of using a single layer polishing pad, a multiple layer, or "stacked" configuration polishing pad may be used. For example, a two-layer polishing pad will have a polishing layer as described above and a softer polymeric layer beneath the polishing layer. Any suitable method can be used for attaching the second layer and any subsequent layers to the polishing layer. In one example, the second layer may be cast directly onto the polishing layer. Another suitable method for adding a second layer to the polishing layer is to adhesively combine the second layer with the polishing layer.

Putting a softer underlayer beneath a harder polishing layer will maintain the overall rigidity of the polishing pad but will still allow enough softness so that the polishing layer will flex to conform to the surface of the wafer. When a multiple layer polishing belt is attached to a belt support, the gripping members of the belt support will penetrate the bottom surface of the polymeric layer. It is therefore intended that the foregoing detailed description be regarded as illustrative rather than limiting and that it be understood that it is the following claims, including all equivalents, which are intended to define the scope of this invention.

What is claimed is:

1. A method of producing a chemical mechanical planarization (CMP) polishing belt structure for use with a linear polisher, the method comprising:

forming a strip of substantially rigid material into a support belt having an interior surface and an exterior surface;

altering at least a portion of the exterior surface of the support belt to form a plurality of gripping members integral with the exterior surface of the support belt; and applying an interior surface of a seamless CMP belt to the exterior surface of the support belt, wherein the plurality of gripping members engages the interior surface of the seamless CMP belt in a non-slip grip.

2. The method of claim 1 wherein altering the exterior surface comprises punching a plurality of holes in a support belt by moving a punch through the support belt from the inside surface to the outside surface wherein a plurality of gripping members are produced.

3. The method of claim 2 wherein punching a plurality of holes comprises forming a plurality of gripping members in the exterior surface oriented perpendicular to a length of the support belt.

4. The method of claim 2 wherein punching a plurality of holes comprises forming a plurality of gripping members in the exterior surface oriented in a non-perpendicular direction towards a rotational direction of the support belt.

5. The method of claim 2 wherein the holes are punched in a substantially uniform pattern along at least a portion of the support belt.

6. The method of claim 2 wherein the holes are punched in a substantially random pattern along at least a portion of the support belt.

7. The method of claim 1 wherein altering the exterior surface comprises forming a plurality of grooves in the exterior surface of the support belt.

8. The method of claim 7 wherein forming a plurality of grooves comprises applying a cold chisel process to the exterior surface of the support belt and wherein a plurality of gripping members are formed by raised portions of material displaced by the cold chisel process.

9. The method of claim 7 wherein forming a plurality of grooves comprises forming a plurality of grooves in the exterior surface oriented perpendicular to a length of the support belt.

10. The method of claim 7 wherein forming a plurality of grooves comprises forming a plurality of grooves in the exterior surface oriented in a non-perpendicular direction towards a rotational direction of the support belt.

11. The method of claim 1 wherein applying an interior surface of a seamless CMP belt comprises:

mounting the support belt on a roller assembly with the plurality of gripping members oriented outwardly from the roller assembly;

placing the seamless CMP belt over the support belt, wherein the seamless CMP belt comprises an inner circumference greater than an outer circumference of the support belt; and tensioning the support belt until the plurality of gripping members engages the interior surface of the seamless CMP belt.

12. The method of claim 1 wherein the support belt comprises stainless steal.

13. The method of claim 1 wherein the seamless CMP belt comprises a single-layer belt.

14. The method of claim 1 wherein the seamless CMP belt comprises a multi-layer belt having at least two layers.

15. A method of producing a chemical mechanical planarization (CMP) polishing belt structure for use with a linear polisher, the method comprising:

forming a strip of substantially rigid material into a support belt having an interior surface and an exterior surface;

attaching a plurality of gripping members to at least a portion of the exterior surface of the support belt; and applying an interior surface of a seamless CMP belt to the exterior surface of the support belt, wherein the plurality of gripping members engages the interior surface of the seamless CMP belt in a non-slip grip.

16. The method of claim 15 wherein attaching a plurality of gripping members comprises using an adhesive to adhere the gripping members to the exterior surface.

17. The method of claim 15 wherein attaching a plurality of gripping members comprises mechanically fastening the gripping members to the exterior surface.

18. The method of claim 15 wherein attaching a plurality of gripping members comprises attaching a plurality of gripping members to the exterior surface oriented perpendicular to a length of the support belt.

19. The method of claim 15 wherein attaching a plurality of gripping members comprises attaching a plurality of gripping members to the exterior surface oriented in a non-perpendicular direction towards a rotational direction of the support belt.

20. The method of claim 15 wherein applying an interior surface of a seamless CMP belt comprises:

mounting the support belt on a roller assembly with the plurality of gripping members oriented outwardly from the roller assembly;

placing the seamless CMP belt over the support belt, wherein the seamless CMP belt comprises an inner circumference greater than an outer circumference of the support belt; and tensioning the support belt until the plurality of gripping members engages the interior surface of the seamless CMP belt.

21. A chemical mechanical planarization (CMP) polishing belt structure for mounting on a roller assembly, the belt structure comprising;

an inner support belt constructed of a rigid material, wherein an outer surface of the support belt comprises a plurality of mechanical grips integrally formed from displaced support belt material;

an outer belt comprising an inner surface mechanically engaged with the mechanical grips of the inner support belt and an outer surface comprising a seamless CMP polishing pad;

wherein an outer diameter of the inner support belt is larger than an inner diameter of the outer belt.

22. The belt structure of claim 21 wherein the inner support belt comprises stainless steal.

23. The belt structure of claim 21 wherein the mechanical grips further comprise ridges extending over at least a portion of a width of the inner support belt.

24. The belt structure of claim 21 wherein the mechanical grips further comprise holes, said mechanical grips dispersed over at least a portion of the length of the inner support belt.

25. The belt structure of claim 21 wherein the mechanical grips form a substantially uniform grid pattern over at least a portion of the length of the inner support belt.

26. The belt structure of claim 21 wherein the mechanical grips are oriented perpendicular to a length of the support belt.

27. The belt structure of claim 21 wherein the mechanical grips are oriented non-perpendicular towards a rotational direction of the support belt.

28. The method of claim 21 wherein the outer belt comprises a single-layer belt.

29. The method of claim 21 wherein the outer belt comprises a multi-layer belt having at least two layers.

30. A chemical mechanical planarization (CMP) polishing belt structure for mounting on a roller assembly, the belt structure comprising;

an inner support belt constructed of a rigid material having an outer surface;

a plurality of mechanical grips attached to the outer surface of the inner support belt;

an outer belt comprising an inner surface mechanically engaged with the mechanical grips of the inner support belt and an outer surface comprising a seamless CMP polishing pad;

wherein an outer diameter of the inner support belt is larger than an inner diameter of the outer belt.

31. The belt structure of claim 30 wherein the mechanical grips are attached to the outer surface with an adhesive.

32. The belt structure of claim 30 wherein the mechanical grips are attached to the outer surface with fasteners.

* * * * *

UNITED STATES PATENT AND TRADEMARK OFFICE

CERTIFICATE OF CORRECTION

PATENT NO. : 6,609,961 B2
DATED : August 26, 2003
INVENTOR(S) : Michael S. Lacy et al.

It is certified that error appears in the above-identified patent and that said Letters Patent is hereby corrected as shown below:

Title page,
Item [56], U.S. PATENT DOCUMENTS, insert
-- 5,782,679 7/1998 Hunter
6,328,642 12/2001 Pant et al. --.

Column 7,
Line 2, delete "steal." and substitute -- steel. -- in its place.

Column 8,
Line 2, delete "steal." and substitute -- steel. -- in its place.

Column 9,
Lines 1 and 3, delete "method" and substitute -- belt structure -- in its place.

Signed and Sealed this

Sixth Day of July, 2004

JON W. DUDAS
*Acting Director of the United States Patent and Trademark Office*